US006914220B2

(12) United States Patent
Tian et al.

(10) Patent No.: US 6,914,220 B2
(45) Date of Patent: Jul. 5, 2005

(54) MICROELECTROMECHANICAL HEATING APPARATUS AND FLUID PRECONCENTRATOR DEVICE UTILIZING SAME

(75) Inventors: Wei-Cheng Tian, Ann Arbor, MI (US); Stella W. Pang, Ann Arbor, MI (US); Edward T. Zellers, Ann Arbor, MI (US)

(73) Assignee: The Regents of the University of Michigan, Ann Arbor, MI (US)

( * ) Notice: Subject to any disclaimer, the term of this patent is extended or adjusted under 35 U.S.C. 154(b) by 21 days.

(21) Appl. No.: 10/396,929

(22) Filed: Mar. 25, 2003

(65) Prior Publication Data

US 2004/0056016 A1 Mar. 25, 2004

Related U.S. Application Data

(60) Provisional application No. 60/413,026, filed on Sep. 24, 2002.

(51) Int. Cl.[7] ..... F27B 11/02

(52) U.S. Cl. ..... 219/408; 73/71.01; 422/98; 422/88; 422/68.1; 219/385

(58) Field of Search ..... 219/408, 385, 219/400, 219, 210, 552, 553, 200, 395, 402, 530, 532, 537, 539; 422/98, 88, 68.1; 73/71.01, 25.01, 25.05

(56) References Cited

U.S. PATENT DOCUMENTS

| | | | | | |
|---|---|---|---|---|---|
| 4,194,108 | A | * | 3/1980 | Nakajima et al. | 219/543 |
| 4,277,742 | A | * | 7/1981 | Kovac et al. | 219/209 |
| 4,472,239 | A | * | 9/1984 | Johnson et al. | 438/49 |
| 4,497,685 | A | * | 2/1985 | Soclof | 438/382 |
| 4,500,412 | A | | 2/1985 | Takahasi et al. | |
| 4,724,356 | A | * | 2/1988 | Daehler | 219/553 |
| 5,464,966 | A | | 11/1995 | Gaitan et al. | |
| 5,481,110 | A | * | 1/1996 | Krishnaswamy et al. | 250/288 |
| 5,493,177 | A | * | 2/1996 | Muller et al. | 313/578 |
| 5,864,144 | A | * | 1/1999 | Laine | 250/504 R |
| 6,171,378 | B1 | | 1/2001 | Manginell et al. | |
| 6,265,222 | B1 | | 7/2001 | DiMeo, Jr. et al. | |
| 6,527,835 | B1 | * | 3/2003 | Manginell et al. | 96/102 |
| 6,705,152 | B2 | * | 3/2004 | Routkevitch et al. | 73/31.05 |
| 6,762,049 | B2 | * | 7/2004 | Zou et al. | 422/68.1 |
| 2003/0027022 | A1 | * | 2/2003 | Arana et al. | 422/200 |
| 2003/0233862 | A1 | * | 12/2003 | Wise et al. | 219/209 |

FOREIGN PATENT DOCUMENTS

JP 8-184514 * 7/1996

OTHER PUBLICATIONS

Ivanov, D., et al., Sputtered Silicate–Limit NASICON Thin Films For Electrochemical Sensors, Solid–State Ionics, Diffusion & Reactions, vol. 67, pp. 295–299, 1994.

Reay, Richard J., et al., Microfabricated Electrochemical Analysis System For Heavy Metal Detection, Sens. And Actuators B, vol. 34, pp. 450–455, 1996.

(Continued)

*Primary Examiner*—Teresa J. Walberg
(74) *Attorney, Agent, or Firm*—Brooks Kushman, P.C.

(57) ABSTRACT

A microelectromechanical heating apparatus and fluid preconcentrator device utilizing same wherein heating elements of the apparatus are sized and spaced to substantially uniformly heat a heating chamber within a heater of the apparatus. Tall, thermally-isolated heating elements are fabricated in Si using high aspect ratio etching technology. These tall heating elements have large surface area to provide large adsorbent capacity needed for high efficiency preconcentrators in a micro gas chromatography system ($\mu$GC). The tall heating elements are surrounded by air gaps to provide good thermal isolation, which is important for a low power preconcentrator in the $\mu$GC system.

30 Claims, 6 Drawing Sheets

OTHER PUBLICATIONS

Bruschi, P., et al., A Micromachined Hotplate On A Silicon Oxide Suspended Membrane, Proc. of 2nd Italian Conference on Sensors and Microsystems, Rome, Italy, 1997, pp. 348–352.

Sberveglieri, G., et al., Silicon Hotplates For Metal Oxide Gas Sensor Elements, Microsystem Technologies 3, pp. 183–190, 1997.

De Moor, P., et al., The Fabrication and Reliability Testing of Ti/TiN Heaters, Proc. Spie, vol. 3874, pp. 284–293, 1999.

Li, B., et al., A New Multi–Function Thin–Film Microsensor Based on $Ba_{1-x}La_xTiO_3$, Smart Mater, Struct., vol. 9, pp. 498–501, 2000.

Solzbacher, F., et al., A Modular System of SiC–based Microhotplates For The Application in Metal Oxide Gas Sensors, Sens. and Actuators B, vol. 64, pp. 95–101, 2000.

Lee, DAE–SIK, et al., A Microsensor Array With Porous Tin Oxide Thin Films and Microhotplate Dangled By Wires in Air, Sens. And Actuators B, vol. 83, pp. 250–255, 2002.

Gotz, A., et al., Thermal and Mechanical Aspects For Designing Micromachined Low–Power Gas Sensors, J. Micromech. Microeng., vol. 7, pp. 247–249, 1997.

Kunt, Tekin A., et al., Optimization of Temperature Programmed Sensing For Gas Identification Using Micro–Hotplate Sensors, Sens. And Actuators B, vol. 53, pp. 24–43.

Rossi, Carole, et al., Realization And Performance of Thin $SiO_2/SiN_x$ Membrane For Microheater Applications, Sens: and Actuators A, vol. 64, pp. 241–245, 1998.

Astie, S., et al., Silicon Oxynitride Membrane For Chemical Sensor Application, Proc. of Mat. Res. Soc. Symp. vol. 518, pp. 99–104, 1998.

Brida, S., et al., Low Power Silicon Microheaters For Gas Sensors, Proc. of 3rd Italian Conference On Sensors And Microsystems, Rome, Italy, pp. 377–382, 1999.

Vincenzi D., et al., Gas–Sensing Device Implemented On A Micromachined Membrane: A Combination of Thick–Film And Very Large Scale Integrated Technologies, J. Vac. Sci. Technol. B., vol. 18, pp. 2441–2445, 2000.

Rich, C.A., et al., An 8–Bit Microflow Controller Using Pneumatiically–Actuated Microvalves, Ph. D. Dissertation, The University of Michigan, 2000.

Najafi, Nader, et al., A Micromachined Ultra–Thin–Film Gas Detector, IEEE Trans. Electron Dev., vol. 41, pp. 1770–1777, 1994.

Patel, Sanjay V., et al., Survivability of A Silicon–Based Microelectronic Gas–Detector Structure For High–Temperature Flow Applications, Sens. And Actuators B, vol. 37, pp. 27–35, 1996.

Manginell, Ronald P., et al., Microfabrication of Membrane–Based Devices By HARSE And Combined HARSE/Wet Etching, Proc. Spie., vol. 3511, pp. 269–276, 1998.

Casalnuvo, Stephen A., et al., 1999 Joint Meeting EFTF–IEEE IFCS, Proc. of The 1999 Joint Meeting of The European Frequency And Time Forum And The IEEE International Frequency Control Symposium, vol. 2, Besancon, France, pp. 991–996, 1999.

Manginell, Ronald P., et al., Microfabricated Planar Preconcentrator, Proc. IEEE Solid–State Sensor And Actuator Workshop, Hilton Head, SC, pp. 179–182, Jun. 2000.

* cited by examiner

MICROELECTROMECHANICAL HEATING APPARATUS AND FLUID PRECONCENTRATOR DEVICE UTILIZING SAME

CROSS-REFERENCE TO RELATED APPLICATION

This application claims the benefit of U.S. provisional application Ser. No. 60/413,026, filed Sep. 24, 2002.

STATEMENT REGARDING FEDERALLY SPONSORED RESEARCH OR DEVELOPMENT

This invention was made with Government support under Contract No. ERC-998 6866 awarded by the National Science Foundation. The Government has certain rights to the invention.

BACKGROUND OF THE INVENTION

1. Field of the Invention

This invention relates to a microelectromechanical heating apparatus and fluid preconcentrator devices utilizing same.

2. Background Art

Researchers have fabricated microheaters using thin metal as shown in references [1]–[12], poly-Si as shown in references [13]–[21], or Si as shown in references [22]–[23] on dielectric membranes with lower thermal mass for chemical sensing and other applications. The ratio of height to width of some prior art microheaters is generally smaller than 1. The range of the ratio is around 1e-4 to 1. The height/width of other microheaters varies from tens of nm/200 $\mu$m to 5 $\mu$m/5 $\mu$m. References [1]–[24] are noted in Table 1 and the list which follows the table.

TABLE 1

COMPARISON OF REPORTED PRECONCENTRATOR/MICROHEATER

| Year/Affiliation/ Reference | Microheater Design | Heater Response | Adsorbent Material | Analytes | Response | Comments |
|---|---|---|---|---|---|---|
| 1985, U.S. Pat. No. 4,500,412 [1] | 0.2 to 20 $\mu$m Pt, Rh, Pd on insulating substrate, such as alumina, quartz, spinel, magnesia, and zirconia | >700° C. at >0.5–5 W | $Nb_2O_5$ or $CeO_2$ consisting of catalyst of Pt, Rh, and Pd | $O_2$ | N/A | Microheater for gas sensor |
| 1994, Ecole Polytech, Canada [2] | Pt on 2 $\mu$m $SiO_2/Si_3N_4$ membrane. Serpentine design, 0.9 × 0.9 $mm^2$ membrane area. | 375° C., 115 mW | N/A | $CO_2$, $SO_x$, $NO_x$, CO, $O_2$ and $H_2O$ | N/A | Microhotplate |
| 1996, Standford Univ., USA [3] | Ir on $SiO_2$/Si substrate | N/A | Mercury | Heavy metal (Pb, Cd, Cu, etc.) | 600/300 s for 1/10 ppb | Liquid phase sensor |
| 1997, Pisa Univ., Italy [4] | 520/50 nm Cr/Al on 520 nm $SiO_2$ membrane. Serpentine design. | 90° C., 1.2 mW | N/A | N/A | N/A | Microheater |
| 1997, Univ. degli Studi di Brescia, Italy [5] | Pt on 700/100 nm $SiO_2/Si_3N_4$ membrane. 900 × 900 $\mu m^2$ serpentine design, 1.7 × 1.7 $mm^2$ membrane area. | 500° C., 130 mW | $SnO_2$ | Co, $NO_2$, $O_3$ | N/A | They found the heat conduction through air is dominated but not heat loss through membrane or support area (2%). |
| 1999, IMEC, Belgium [6] | 5/30 nm Ti/TiN on 1 $\mu$m $SiO_2$/Si substrate. I line design, 1 $\mu$m wide heater design. | 300° C., 138 mW | N/A | N/A | N/A | Microheater |
| 2000, Hong Kong Univ., China [7] | 1 $\mu$m $Ba_{1-x}La_xTiO_3$ on 25 nm $SiO_2$/Si substrate | 400° C. | N/A | N/A | N/A | Thin film resistor for humidity sensor. |
| 2000, Technical Univ. of Berlin, Germany [8] | 200 nm $HfB_2$ on 1 $\mu$m SiC membrane. 80 × 80 $\mu m^2$ square heater area on 100 × 100 $\mu m^2$ membrane area. | 380° C., 35 mW | N/A | N/A | N/A | The active part is separated from the surrounding membrane by 6 SiC microbridges. |
| 2001, U.S. Pat. No. 6,265,222 [9] | N/A (Use conventional thin film heater on the membrane). | N/A | $H_2$-interactive metal film (e.g. Mg, Ca) covered by a $H_2$-permeable barrier layer (e.g. Pd, Pt) | $H_2$ | N/A | Microheater for gas sensor. |
| 2002, Telecommunication Basic Research Lab, South Korea [10] | Thin Pt heater on 150 $\mu$m O/N/O Si diaphragm. | 400° C., 100 mW | $SnO_2$ (with Pt or Au as catalysts) | Explosive gases (e.g. butane, propane, Co) | | |
| 1994, NIST, U.S. Pat. No. 5,464,966 [11], [13] | Described in [19]. | 500° C., 50 mW | $SnO_2$ | $H_2$ and $O_2$ | Response less than 200 s. | Microheater for hotplate. |
| 1997, Centro Nacional de Microelectron, Spain [12] | 480 nm $n^{++}$ poly-Si on the 2000/200 nm $SiO_2/Si_3N_4$ membrane. Serpentine design, 0.5 × 0.5 $mm^2$ heated area. | 350° C., 62 mW | N/A | N/A | N/A | Microhotplate |
| 1998, LAAS CNRS France [14] | 500 nm $n^{++}$ poly-Si on 500/220 nm $SiO_2/SiN_{1.2}$ membrane. | 230° C., 50 mW | N/A | N/A | NA/ | Microheater |

TABLE 1-continued

COMPARISON OF REPORTED PRECONCENTRATOR/MICROHEATER

| Year/Affiliation/ Reference | Microheater Design | Heater Response | Adsorbent Material | Analytes | Response | Comments |
|---|---|---|---|---|---|---|
| | 1.6 × 1.6 $mm^2$ microheater area, 3 × 3 $mm^2$ membrane area. | | | | | |
| 1998, Instituto per la Ricerca Scientifica e Tecnologica, Italy [15] | 450 nm $n^{++}$ poly-Si on the 1150 nm $SiO_2$ membrane. Serpentine design, 2.5 × 2.5 $mm^2$ membrane area. | 500° C., 30 mW | N/A | N/A | N/A | Microheater for gas sensor. |
| 1999, Ferrara Univ., Italy [16] | 450 nm $n^{++}$ poly-Si on the 800/200 nm $SiO_2/Si_3N_4$ membrane. Serpentine design. | 400° C., 30 mW | 400 $\mu$m tall $SnO_2$ on 0.0875 $mm^2$ | Co, $CH_4$ | N/A | Microheater for gas phase detection. |
| 2000, Motorola France [17] | Poly-Si on 1.5 mm $SiO_xN_y$ membrane. | 450° C., 65 mW | $SnO_2$ | N/A | N/A | Microhotplate |
| 2000, Univ. of Michigan, USA [18] | 0.7 $\mu$m $p^{++}$ poly-Si on $SiO_2/Si_3N_4/SiO_2/p^{++}$ Si. Diamond grid design. | 25 mW | N/A | N/A | N/A | $p^{++}$ Si is the structural frame. |
| 1994–1996, Univ. of Michigan, USA [19], [20] | 5 $\mu$m $p^{++}$ Si underneath 300/250/700 nm $SiO_2/Si_3N_4/SiO_2$. Meander design, 1 $mm^2$ membrane area, 0.12 $mm^2$ sensing area. | 1200° C., 230 mW | 3/5 nm $Pt/TiO_2$ | $O_2$ and $H_2$ | N/A | Microheater for gas sensor. |
| 1998–2001, Sandia Lab., U.S. Pat. No. 6,171,378 [21]–[24] | 100/15 nm Pt/Ti on the 100/640 nm $SiO_2/Si_3N_4$ membrane. Serpentine design, 5.73 $mm^2$ membrane area. | 200° C. in 11 ms, 67 mW | Surfactant templated (ST) sol gel | Dimethyl methyl phosphonate | 5 s for 50 ppb at a gas flow rate of 3 ml/min | Gas phase preconcentrator. |

References:
[1] H. Takahashi et al., "Oxygen Sensor with Heater," U.S. Pat. No. 4,500,412, 1985.
[2] D. Ivanov et al., "Sputtered Silicate-Limit NASICON Thin Films for Electrochemical Sensors," SOLID-STATE-IONICS, DIFFUSION & REACTIONS, Vol. 67, pp. 295–299, 1994.
[3] R. J. Reay et al., "Microfabricated Electrochemical Analysis System for Heavy Metal Detection," SENS. AND ACTUATORS B, Vol. 34, pp. 450–455, 1996.
[4] P. Bruschi et al., "A Micromachined Hotplate on a Silicon Oxide Suspended Membrane," PROC. OF 2ND ITALIAN CONFERENCE ON SENSORS AND MICROSYSTEMS, Rome, Italy, 1997, pp. 348–352.
[5] G. Sberveglieri et al., "Silicon Hotplates for Metal Oxide Gas Sensor Elements," MICROSYSTEM TECHNOLOGIES 3, pp. 183–190, 1997.
[6] P. De Moor et al., "The Fabrication and Reliability Testing of Ti/TiN Heaters," PROC. SPIE, Vol. 3874, PP. 284–293, 1999.
[7] B. Li et al., "A New Multi-Function Thin-Film Microsensor Based on $Ba_{1-x}La_xTiO_3$," SMART MATER. STRUCT., Vol. 9, pp. 498–501, 2000.
[8] F. Solzbacher et al., "A Modular System of SiC-Based Microhotplates for the Application in Metal Oxide Gas Sensors," SENS. AND ACTUATORS B, Vol. 64, pp. 95–101, 2000.
[9] J. F. DiMeo et al., "Micro-Machined Thin Film Hydrogen Gas Sensor and Method of Making and Using The Same," U.S. Pat. No. 6,265,222, 2001.
[10] D.-S. Lee et al., "A Microsensor Array With Porous Tin Oxide Thin Films and Microhotplate Dangled By Wires in Air," SENS. AND ACTUATORS B, Vol. 83, pp. 250–255, 2002.
[11] M. Gaitan et al., "Micro-Holplate Devices and Methods for Their Fabrication," U.S. Pat. No. 5,464,966, 1994.
[12] A. Gotz et al., "Thermal and Mechanical Aspects for Designing Micromachined Low-Power Gas Sensors," J. MICROMECH. MICROENG., Vol. 7, pp. 247–249, 1997.
[13] T. A. Kunt et al., "Optimization of Temperature Programmed Sensing for Gas Identification Using Micro-Hotplate Sensors," SENS. AND ACTUATORS B, Vol. 53, pp. 24–43, 1998.
[14] C. Rossi et al, "Realization and Performance of Thin $SiO_2/SiN_x$ Membrane for Microheater Applications," SENS. AND ACTUATORS A, Vol. 64, pp. 241–245, 1998.
[15] S. Astie et al., "Silicon Oxynitride Membrane for Chemical Sensor Application," PROC. OF MAT. RES. SOC. SYMP, Vol. 518, pp. 99–104, 1998.
[16] S. Brida et al., "Low Power Silicon Microheaters for Gas Sensors," PROC. OF 3RD ITALIAN CONFERENCE ON SENSORS AND MICROSYSTEMS, Rome, Italy, pp. 377–382, 1999.
[17] D. Vincenzi et al., "Gas-Sensing Device Implemented On A Micromachined Membrane: A Combination Of Thick-Film And Very Large Scale Integrated Technologies," J. VAC. SCI. TECHNOL. B, Vol. 18, pp. 2441–2445, 2000.
[18] C. A. Rich, "A Thermopneumatically-Actuated Silicon Microvalve and Integrated Microflow Controller," Ph. D. Dissertation, The University of Michigan, 2000.
[19] N. Najafi et al., "A Micromachined Ultra-Thin-Film Gas Detector," IEEE TRANS. ELECTRON DEV., Vol. 41, pp. 1770–1777, 1994.
[20] S. V. Patel et al., "Survivability of a Silicon-Based Microelectronic Gas Detector Structure for High-Temperature Flow Applications," SENS. AND ACTUATORS B, Vol. 37, pp. 27–35, 1996.
[21] R. P. Manginell et al. "Microfabrication of Membrane-Based Devices by HARSE and Combined HARSE/Wet Etching," PROC. SPIE, Vol. 3511, pp. 269–276, 1998.
[22] S. A. Casalnuovo et al., "Gas Phase Detection with an Integrated Chemical Analysis System," PROC. OF THE 1999 JOINT MEETING OF THE EUROPEAN FREQUENCY AND TIME FORUM AND THE IEEE INTERNATIONAL FREQUENCY CONTROL SYMPOSIUM, Vol. 2, Besancon, France, pp. 991–996, 1999.
[23] R. P. Manginell et al., "Microfabricated Planar Preconcentrator," PROC. IEEE SOLID-STATE SENSOR AND ACTUATOR WORKSHOP, Hilton Head, SC, pp. 179–182, June 2000.
[24] R. P. Manginell et al., "Chemical Preconcentrator," U.S. Pat. No. 6,171,378, 2001.

The analysis of complex vapor mixtures is typically performed by gas chromatography (GC) whereby a discrete sample of air is captured in a preconcentrator/focuser (PCF), introduced to the head of a polymer-coated separation column, and then eluted down the column under a positive pressure of some inert carrier gas. Separation of the components by differential partitioning along the column, which is typically ramped during the analysis to some elevated temperature, followed by detection by a downstream detector permits the determination of the mixture components by their retention times and response profiles. Traditional GC instrumentation is large and requires high power. Field portable instruments have been developed for environmental, clinical, aerospace, process control, and other applications, but remain limited by their size/weight (several kg) and power requirements (tens-to-hundreds of W).

A number of efforts have been mounted over the past 25 years to develop miniaturized GC components using Si-micromachining technology. The work of Terry et al. in 1979 was the first such effort and others have followed with varied success. "A Gas Chromatograph Air Analyzer Fabricated on a Silicon Wafer", *IEEE Trans. Electron Dev.,* vol. 26, pp. 1880–1884, 1979. The system reported recently by Frye-Mason et al. at Sandia National Laboratories, developed primarily for detection of chemical warfare agents, combines an adsorbent-coated, heated-membrane preconcentrator with a 1-m etched-Si separation column and a detector consisting of an integrated array of three surface acoustic wave sensors, and represents the most comprehensive effort, to date, to construct an entirely microfabricated system. "Hand-Held Miniature Chemical Analysis System ($\mu$ChemLab) for Detection of Trace Concentrations of Gas Phase Analytes", in *Proc. of Micro Total Analysis Systems* ($\mu$-*TAS*) '00 *Workshop,* Enschede, Netherlands, pp. 229–232, May 2000.

There is a need for a more sophisticated monolithic microscale GC ($\mu$GC) for the analysis of complex vapor mixtures encountered in the ambient, indoor environment, breath, chemical processing equipment, and head-space samples of soil or other materials contaminated with organic compounds that give rise to vapor contamination in the air at concentrations as low as parts-per-billion (ppb), as shown in FIG. 1. The key components of such a $\mu$GC are shown in FIG. 2. An inlet filter 10 prevents particle entrainment and an on-board vapor generator provides an internal standard for calibration, quality control, system diagnostics, and temperature compensation. A multi-stage adsorbent PCF 14 collects vapors spanning a wide range of vapor pressures with adequate capacity to achieve detection limits in the low-ppb concentration range while also producing narrowly focused injection plugs upon thermal desorption (with reversal of flow direction) for efficient high-speed separations. A dual-column separation stage 16 allows the retention of components to be adjusted via temperature programming and/or pressure programming to maximize resolution and minimize analysis time. Detection by a sensor array 18 yields a fingerprint of eluting analytes, much like a mass spectrometer, which will aid in identifying unknowns from mixtures of arbitrary composition. Various microvalves 20 including a tuning valve 21 direct sample flow through the system under the suction pressure provided by a system diaphragm micropump 22. An internal standard 23 is also provided.

Sample collection and injection onto the column are important factors. A sufficient sample volume (or mass) is required so that quantitative analysis of each vapor component is possible at desired detection limits, and the column injection volume must be small in order to minimize dilution, referred to as inlet band broadening, which reduces the resolving power of the column. Thus, the PCF 14 must contain sufficient adsorbent mass (surface area) to ensure quantitative trapping of vapors from the sample stream, but small enough to be rapidly heated to ensure complete desorption and to minimize the desorbed-vapor bandwidth. Minimizing the power required for heating is also important.

Conventional preconcentrators, or so-called microtraps, consist of a stainless-steel or glass capillary tube packed with one or more granular adsorbent material. For desorption, a current is passed through the stainless-steel tube or through a metal wire coiled around the glass capillary tube. Capillary tubes suffer from large dead volume and limited heating efficiency due to their larger thermal mass.

Micromachining technology can overcome these limitations by significantly reducing the dead volume and thermal mass. Microheaters fabricated on dielectric membranes with low thermal mass have been reported for chemical sensing and other applications. Similar structures coated with thin adsorbent films are used for preconcentration and focusing in the Sandia microsystem referred to in reference [24]. Although rapid thermal desorption at relatively low power can be achieved with such structures, the capacity of the PCF is very low and therefore not suitable for quantitative analysis of multi-vapor mixtures. As the adsorbent layer thickness is increased to reach sufficient capacity, the thermal transfer efficiency from the thin heater on the membrane decreases dramatically, calling for alternative heater designs.

SUMMARY OF THE INVENTION

An object of the present invention is to provide a microelectromechanical heating apparatus and fluid preconcentrator device utilizing same wherein heating elements of the apparatus are sized and spaced to substantially uniformly heat a heating chamber within a heater of the apparatus.

In carrying out the above object and other objects of the present invention, a microelectromechanical heating apparatus is provided. The apparatus includes a first substrate and a heater including an array of heating elements supported in spaced relationship on the substrate. The heating elements are sized and spaced to substantially uniformly heat a heating chamber within the heater.

The heating elements may be located in the heating chamber and a ratio of height to width of each of the heating elements may be greater than one.

The first substrate may be a semiconductor substrate such as a silicon substrate.

The apparatus may further include a support for supporting each of the heating elements at a single support location. The support may support each of the heating elements at an end of the heating elements. The support may be a membrane, wherein each of the heating elements conducts heat from the membrane.

The apparatus may further include a support for supporting each of the heating elements at a pair of spaced support locations. The support may support each of the heating elements at ends of the heating elements, wherein each of the heating elements converts electrical energy into heat.

The apparatus may further include interconnects formed on the heater and electrically coupled to the heating elements to receive an electrical signal which in turn causes electrical current to flow through the heating elements to control and directly heat the heating elements.

The support may be formed on the substrate and thermally isolated from the substrate.

The apparatus may further include a second substrate connected to the first substrate wherein the heating elements are separated from the first and second substrates by air gaps to thermally isolate the heating elements.

The apparatus may further include at least one sensor to sense a physical or chemical stimulus and provide a corresponding signal for control purposes. The at least one sensor may include at least one temperature sensor for controlling temperature within the heating chamber.

The heating elements may be fabricated in Si, metal, or any conductive material.

The heating elements may be post, slat, grid or serpentine structures having relatively large surface areas.

The heating elements may be formed in multiple stages with various heater dimensions and adsorbents in each stage.

Further in carrying out the above object and other objects of the present invention, a microelectromechanical heating apparatus for a micro analytical system is provided. The apparatus includes a first substrate and a heater including at least one array of heating elements supported in spaced relationship on the substrate. The heating elements are sized and spaced to substantially uniformly heat a heating chamber within the heater.

The apparatus may further include at least one sensor to sense a physical or chemical stimulus and provide a corresponding control signal. The at least one sensor may include at least one temperature sensor for controlling temperature within the heating chamber.

The heater may include a plurality of arrays of large surface area heating elements to provide substantially uniform 3D heating.

Still further in carrying out the above object and other objects of the present invention, a microelectromechanical heating apparatus for a microsensing system is provided. The apparatus includes a first substrate and a heater including an array of heating elements supported in spaced relationship on the substrate. The heating elements are sized and spaced to substantially uniformly heat a heating chamber within the heater.

The system may be a chemical microsensing system and the apparatus may further include chemical sensing material disposed in the heating chamber.

The apparatus may further include at least one sensor to sense a physical or chemical stimulus and provide a corresponding control signal.

The microsensing system may serve as a 3D micro chemical sensing system. The apparatus may further comprise sensing material applied to large surface area of the heating elements for improved sensitivity and response time and sensing electrodes distributed along a surface of the heating apparatus for 3D detection of chemical distribution.

The microsensing system may further serve as a 3D micro temperature sensing system. The apparatus may further comprise resistive temperature sensors, such as poly-Si, distributed along a surface of the heating apparatus for 3D monitoring of temperature distribution.

The microsensing system may further serve as a 3D micro pressure sensing system. The apparatus may further comprise a resistive pressure sensor, such as poly-Si, distributed around a surface of the heating apparatus for 3D monitoring of pressure distribution.

Yet still further in carrying out the above object and other objects of the present invention, a microelectromechanical, fluid preconcentrator device which sorbs at least one fluid species of interest from a fluid over time and releases the at least one fluid species of interest upon demand is provided. The device includes a substrate and at least one heater including an array of heating elements supported in spaced relationship on the substrate. The heating elements are sized and spaced to substantially uniformly heat at least one heating chamber within the at least one heater. The device further includes at least one sorptive material located within the at least one heating chamber and capable of sorbing the at least one fluid species of interest from a fluid over time and releasing the at least one fluid species of interest upon heating the at least one sorptive material by the at least one heater.

The heating elements may be located in the at least one heating chamber.

The ratio of height to width of each of the heating elements may be greater than one.

The spaced heating elements may be separated by air gaps wherein the at least one sorptive material is located in the air gaps.

The device may further include a second substrate connected to the first substrate wherein the heating elements are separated from the first and second substrates by air gaps to thermally isolate the heating elements.

The device may further include a cover plate for completely enclosing the at least one heating chamber wherein the cover plate has an inlet and an outlet for establishing fluid communication with the at least one sorptive material within the at least one heating chamber.

The device may further include tubes sealingly disposed within the inlet and the outlet. The tubes may have low thermal conductivity to minimize conductive heat loss to structures external to the at least one heating chamber.

The at least one sorptive material may be layered on sidewalls of the heating elements.

The at least one sorptive material may form a surface layer of the heating elements.

The at least one device may be a multistage device including a plurality of heaters and a plurality of sorptive materials for sorbing and releasing different fluid species of interest within heating chambers of the heaters. The device may further include a temperature sensor for each of the stages. Each temperature sensor may sense temperature and provide a signal for controlling temperature within its respective heating chamber.

The device may be a single stage device including a single heater and a single sorptive material for sorbing and releasing a single fluid species of interest within a single heating chamber of the heater. The device may further include a temperature sensor for sensing temperature and providing a signal to control temperature within the single heating chamber wherein the chamber may be used as a reaction chamber.

The at least one sorptive material may include adsorbents. The adsorbents may be porous carbon granules, metal films, Si or materials with porous and sorptive properties.

The at least one sorptive material may further include adsorbents located around the at least one heater. The adsorbents may be conformal coatings formed by using CVD or plasma deposition.

The at least one sorptive material may further include an adsorbent layer, such as porous Si, formed along a surface of the heating elements.

The at least one sorptive material may be formed by applying plasma treatments to a surface of the heating elements to increase porosity of the heating elements.

A width of the heating elements may be reduced to the nanometer range. The at least one heater may be a nanoheater which provides larger surface area per unit volume compared to a microheater. The size of the nanoheater may be smaller than a microheater for the same surface area, and has a smaller thermal mass. The nanoheater may have a lower power consumption and faster thermal response than a microheater.

The above object and other objects, features, and advantages of the present invention are readily apparent from the following detailed description of the best mode for carrying out the invention when taken in connection with the accompanying drawings.

DETAILED DESCRIPTION OF THE PREFERRED EMBODIMENTS

The present invention relates generally to a micro analytical system and, in particular, to a high aspect ratio microheater, with tall and large surface area heating elements or structures, for a microfabricated preconcentrator/focuser ($\mu$PCF). This high aspect ratio bulk-micromachined Si heater can be packed in an embodiment with a small quantity of adsorbent material to form a $\mu$PCF. It is designed to preconcentrate vapors for subsequent focused thermal desorption and chemical analysis in a micro gas chromatograph ($\mu$GC). Previous efforts on miniaturizing PCFs have focused on thin heated membranes coated with adsorbents. However, they are limited in achieving high sensitivity and quantitative analysis due to small adsorbent capacity. Besides, as the adsorbent layer thickness is increased to reach sufficient capacity, the thermal transfer efficiency from the thin heater on the membrane decreases dramatically, calling for alternative heater designs. By using the $\mu$PCF of the present invention, uniform heating of sufficient adsorbent enables quantitative chemical analysis with high sensitivity and resolution. The temperature-controlled microheater also functions as a micro chemical reactor for micro analysis of fluid, either in gas phase or liquid phase. It provides a large heating surface and sufficient capacity and is designed to uniformly heat a large amount of fluid in between heating structures or elements.

Compared to the prior art preconcentrators, the present designs accommodate larger adsorbent mass and greater surface area for quantitative analysis of a broad range of vapors in a $\mu$GC. In addition, higher thermal transfer efficiency can be obtained by having a larger area contact between the tall heating elements and adsorbents, leading to very high preconcentration factors at low power.

Figure 7A:
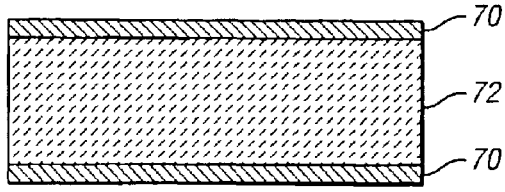
FIGS. 7*a*–7*g* are side cross-sectional views illustrating process flow to fabricate the heating apparatus of the present invention in silicon with and without a supporting membrane.
Figure 7B:
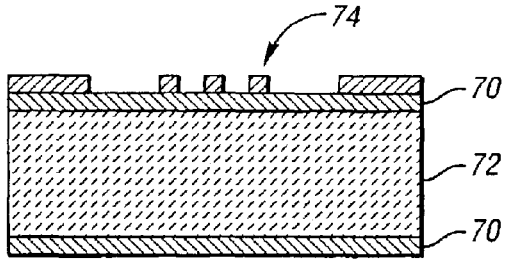
Figure 7C:
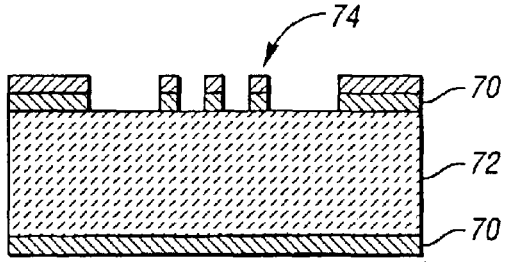
Figure 7D:
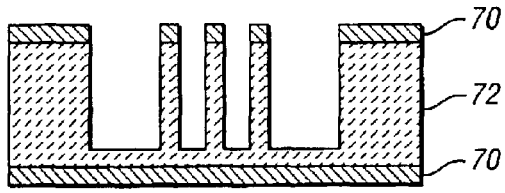
Figure 7E:
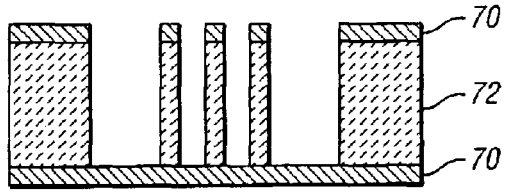
Figure 7F:
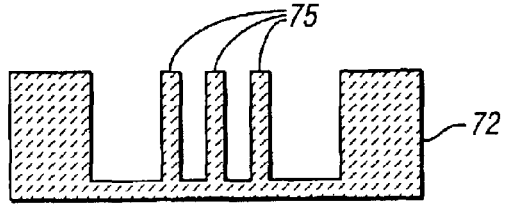
Figure 7G:
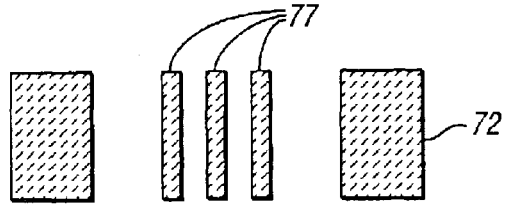

FIGS. 7*a* through 7*g* show a process flow for fabricating freestanding microheaters and microheaters on membrane. Thermal oxide 20 is grown on Si wafers 22 at 1100° C. for 10 hrs. to a thickness of 2 $\mu$m. The oxide 20 was etched in a parallel plate reactive ion etching system using 100 W rf power, 10 sccm $CF_4$, and 10 sccm $CHF_3$ at 40 mTorr to define the microheaters and contact areas. Boron was diffused into Si at 1175° C. for 30 minutes, followed by a 20 minute wet oxidization and 1 hr. annealing in $N_2$ at 1100° C. Metal contacts consist of 20/500 nm Cr/Au were evaporated and lifted off. These metal contacts and the heavily doped $p^{++}$-Si result in low contact resistance for reduced power consumption. Photoresist mask for deep etching was formed by patterning 7 $\mu$m tall AZ 9260 photoresist 74. The etch conditions were optimized to provide fast etch rates, vertical profiles, and smooth sidewalls in Si using a combination of etch and passivation cycles. In the 11 s etch cycles, 800 W source power, and 8 W stage power were used at 30 mTorr with 130 sccm $SF_6$ and 13 sccm $O_2$. The self-induced dc bias at the stage was 85 V. In the 8 s passivation cycles, 600 W source power was applied with no stage power at 13 mTorr and 85 sccm $C_4F_8$. Microheating elements 75 supported on a membrane 76 are shown in FIG. 7*f*. Freestanding microheating elements 77 are shown in FIG. 7*g*.

Figure 4A:
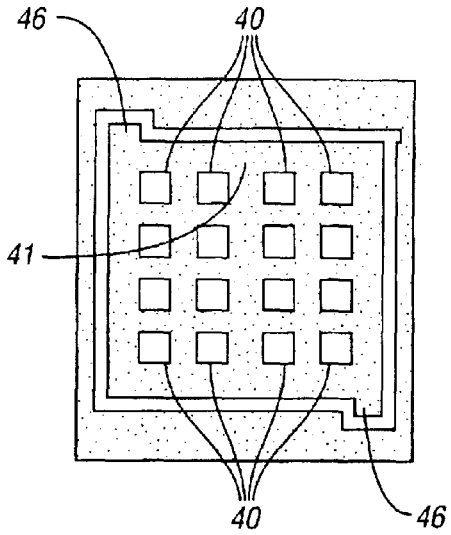
FIG. 4*a* is a top schematic view of a preconcentrator having post heating elements.
Figure 4B:
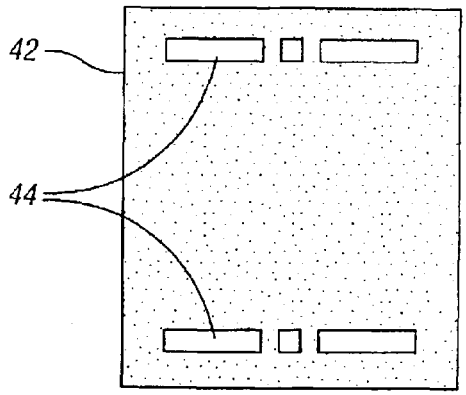
FIG. 4*b* is a back schematic view of a preconcentrator having post heating elements and electrical interconnects.

15 $\mu$m wide posts 40 with 25 $\mu$m air gaps 41 and 250 $\mu$m tall were fabricated on a membrane 42 as shown in FIGS. 4*a* and 4*b*. The etch time was 4 hr. and a fast etch rate >1 $\mu$m/min was achieved.

High aspect ratio microheating elements are formed by etching Si to various depths. With through wafer etching, tall, freestanding microheating elements 77 are generated after oxide removal as shown in FIG. 7*g*. The freestanding microheating elements 77 without membranes allow power consumption to be reduced. To get microheating elements and membranes with different thicknesses, a combination of frontside and backside dry etching is used.

Figure 3:
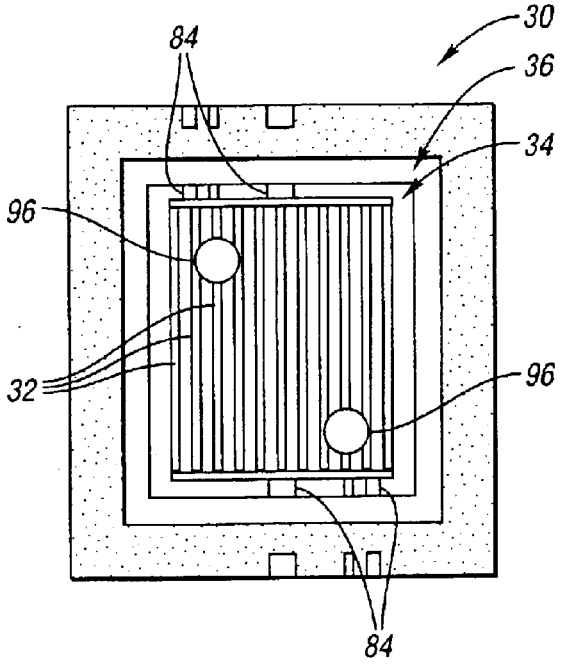
FIG. 3 is a top schematic view of a fluid preconcentrator device including a heating apparatus of a first embodiment of the present invention.

FIG. 3 shows a freestanding microheater 30 including slats 32 with gaps therebetween. The heating elements or slats 32 are surrounded by an air gap 34 and a bonding area 36 wherein the microheater 30 is bonded to a substrate (not shown).

The frontside etching defined the thickness or height of the microheater, whereas the backside etching removed the rest of the Si substrate to form freestanding slats (i.e., FIGS. 3 and 7*g*). For heating elements with a membrane (i.e., FIGS. 4 and 7*f*), frontside etching was used to etch to the desired microheater thickness, and left behind part of the Si substrate as the membrane. The thickness of the membrane can be adjusted by backside etching without the mask. Heaters with membrane thickness varying from 20 to 140 $\mu$m has been formed using this frontside and backside etching combination.

Microfabricated Preconcentrator/Focuser

The vapor adsorption capacity is the performance criterion that governs the minimum size of a PCF, because complete removal of vapors from the sample stream is important for quantitative analysis of vapor concentrations. Thus, a certain minimum mass of adsorbent is required, which depends on the nature, number and concentrations of vapors to be analyzed. At the same time, desorption efficiency must be nearly 100% to avoid carryover of residual vapor to subsequent samples and the desorption bandwidth must be minimized (e.g., <a few s) for efficient chromatographic separations. These latter criteria demand rapid heating to high temperature. Each of these criteria should be met while also minimizing the power, or energy, per analysis, to permit repeated analyses with battery power.

The adsorption capacity is typically determined by continuously drawing a sample of vapor in air through the PCF and monitoring downstream for the appearance of breakthrough. The breakthrough volume, $V_b$, is used as a measure of capacity and is defined as the volume required to observe some pre-set fraction of the inlet vapor concentration (e.g., 1% or 10%) downstream from the PCF. The modified Wheeler Model relates several important PCF design and performance parameters to the $V_b$ of a granular adsorbent bed under a continuous vapor challenge:

$$V_b = \frac{W_e W_b}{C_o}\left[1 - \frac{1}{k_v \tau}\ln\left(\frac{C_o}{C_x}\right)\right] \quad (1)$$

where $V_b$ is in liters, $W_e$ is the kinetic adsorption capacity (adsorbate mass/adsorbent mass), $W_b$ is the packed-bed mass (g), $\tau = W_b/(\rho_b Q)$ is the bed residence time (min), $\rho_b$ is the adsorbent bed density, Q is the volumetric flow rate ($cm^3$/min), $k_v$ is the kinetic rate constant ($min^{-1}$), $C_o$ is the inlet concentration ($g/cm^3$), and $C_x$ is the outlet concentration ($g/cm^3$). The empirically determined variables $W_e$ and $k_v$ vary with the vapor species and concentration ($C_o$), but they are independent of bed mass ($W_b$) and sampling flow rate (Q).

This model predicts a decrease in $V_b$ with decreasing $\tau$. The critical bed residence time, $\tau_c$, determined at $V_b$=0, represents the theoretical limit to miniaturization of the PCF. In other words, for a given volumetric flow rate, this defines the length of the PCF: when $\tau=\tau_c$, some fractional breakthrough will occur immediately after sampling. Although some degree of preconcentration still occurs under such conditions, quantitative analysis is compromised.

In a related study concerned with the development of a meso-scale GC for monitoring indoor air contaminants, it was found that a multi-stage PCF containing a series of three commercial adsorbents of gradually increasing surface area (Carbopack B, Carbopack X, and Carboxen 100) provided the best tradeoff between adsorption capacity and desorption efficiency/bandwidth for mixtures of up to 44 vapors spanning a wide range of structure and volatility at concentrations as high as 100 ppb. Vapors that are less volatile are trapped on the adsorbent with the lowest surface area and more volatile vapors are trapped on the two downstream adsorbent materials, which have higher surface areas.

Extrapolation of the results from that study, which employed a conventional glass-capillary PCF design, indicate that the mass of each adsorbent required for each stage of the PCF being developed here would be in the range of 0.6 to 1.8 mg for a similar application. A mass of 1.8 mg of Carbopack X was selected for the current single-stage PCF study. The volume occupied by this adsorbent material is approximately 4.4 $\mu$L, based on the known packed-bed density of 0.4 $g/cm^3$. For a wafer thickness of 520 $\mu$m, this requires the area of the PCF to be 9 $mm^2$. For a sampling flow rate of 25 $cm^3$/min, $\tau_c$ is $3.6\times10^{-5}$ min, the critical bed mass is 0.36 mg, and the critical bed length is 590 $\mu$m (again, based on data from our previous study and assuming a 3 mm width). Since the breakthrough volume decreases rapidly as $\tau_c$ is approached, it is advisable to operate well above the corresponding critical bed length. These considerations supported the decision to design the current PCF with lateral dimensions of 3 mm×3 mm.

The final consideration is that of heating rate and power efficiency. For optimal desorption rates, the adsorbent should be maintained in intimate contact with the heater and the mass of the heater should be minimized. For the mass of adsorbent required, a thin heater on a membrane referred to in the prior art would not provide efficient heating.

Therefore, two alternative designs, using freestanding slats and supported posts as the heating elements (i.e., FIGS. 3, 4*a* and 4*b*, respectively), were considered, each of which employs vertically oriented heating elements spaced just wide enough to accommodate a single granule of the adsorbent material. FIG. 3 shows one way of heating wherein the heating elements 32 are heated directly using slat heaters with contacts at two ends.

FIGS. 4*a* and 4*b* show another way of heating wherein the membrane 42 is heated and conductively transfer heat to the heating elements 40 above. For both slat and post heaters, electrical interconnects or wire electrodes 44 (i.e. FIG. 4*b*) are provided on the backside of the microheater. FIG. 4*a* also shows inlet/outlets 46 for the preconcentrator. Other considerations included thermal isolation from the substrate, uniformity of heat distribution, as well as fluidic parameters such as the uniformity of flow and the pressure drop across the structure.

Fabrication of Sealed, Single-Stage PCF

Heater elements or structures such as the slats 32 of FIG. 3 were fabricated from a p-Si wafer polished on both sides. As shown in FIGS. 8*a*-8*h*, initially 0.5 $\mu$m thermal oxide was grown on the wafer 82 at 1100° C. for 2 hr, followed by deposition of 0.1/0.1/0.6 $\mu$m tall oxide/nitride/oxide films 80 or stack in a low-pressure chemical vapor deposition (LPCVD) furnace. To define the contact areas, the frontside oxide/nitride/oxide layers 80 were etched for 2 hrs. in a parallel-plate reactive ion etching system using 100 W rf power, 10 sccm $CF_4$, and 10 sccm $CHF_3$ at 40 mTorr.

Figure 8A:
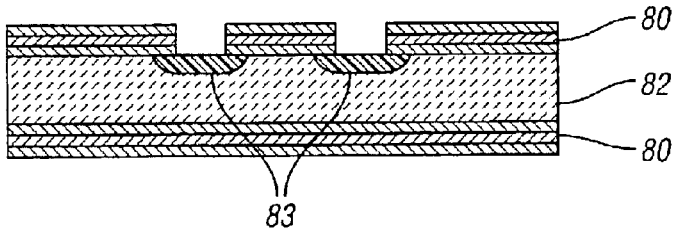
FIGS. 8*a*–8*h* are side cross-sectional views illustrating process flow to fabricate the fluid preconcentrator device of FIG. 3.
Figure 8B:
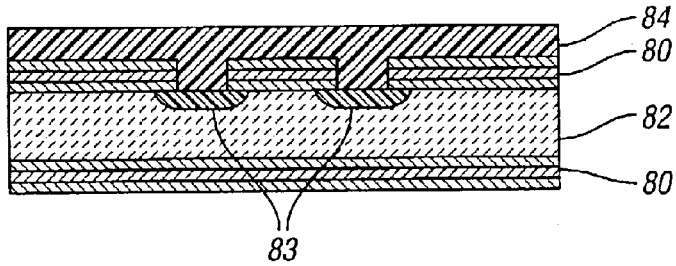
Figure 8C:
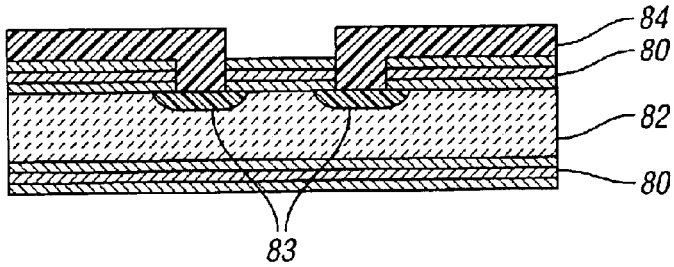

A shallow B diffusion 83 was then performed at 1175° C. for 30 minutes to dope the contacts, as illustrated in FIG. 8*a*.

Figure 8D:
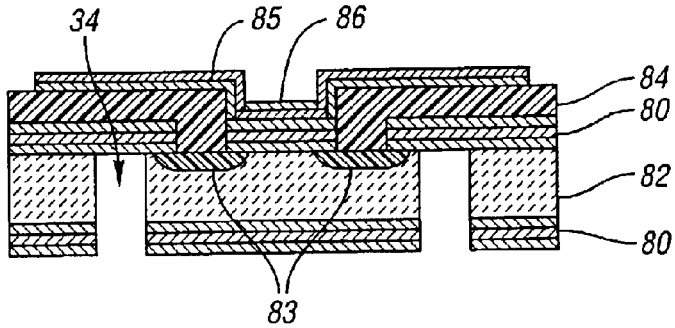

Then, a 0.5 $\mu$m layer 84 of poly-Si was deposited by LPCVD at 580° C. for 2.5 h. A second shallow B diffusion was performed to heavily dope the poly-Si layer 84 to form good ohmic contacts, and was followed by a shallow Si etch to define the poly-Si interconnects and resistive temperature sensors 84, as shown in FIG. 3. As shown in FIG. 8*d*, another dielectric stack 85 of 0.6/0.1/0.6 $\mu$m tall oxide/nitride/oxide was deposited on top of the poly-Si layer 84 for electrical isolation, and a second 1 $\mu$m poly-Si layer 86 was deposited on top of this dielectric film 85 to promote adhesion during Al solder bonding. In order to open the contact area for wire bonding, the second dielectric stack 85 was patterned and etched away.

On the backside of the wafer 82, a 10 $\mu$m masking layer of photoresist (AZ 9260, Shipley, Marlborough, Mass.) was patterned to define the annular air gap 34 underneath the interconnects, as shown in FIGS. 3 and 8*d*. The bottomside dielectric stack 80 was etched first, followed by an optimized deep Si etch using a combination of etch and passivation cycles. The remaining Si underneath the poly-Si/oxide/nitride/oxide interconnects was then etched away leaving the membrane suspended over the annular air gap 34.

Figure 8E:
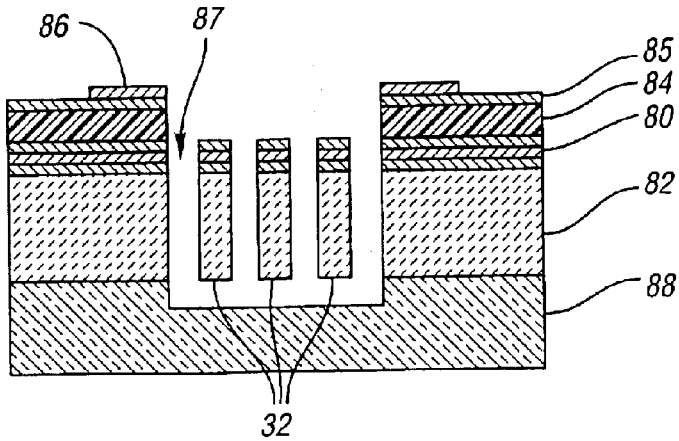

Wafer-level anodic bonding to a pre-etched pyrex glass substrate 88 was then performed at 400° C. with an applied voltage ramp of 250 to 1000 V in 10 minutes, as shown in FIG. 8*e*. The pyrex substrate 88 was patterned to create a 50/2000 nm Cr/Au etch mask to define two mesa structures that would form the contacts at the base of the periphery of the Si heater. The pyrex 88 was wet-etched ($HF:HNO_3$:DI $H_2O$=7:3:10) for 40 minutes to form 40 $\mu$m high mesas.

The high-aspect-ratio, 520 μm (h)×50 μm (w)×3000 μm (1) slats 32, serving as heating elements in the microheater 30 of FIG. 3, were spaced 220 μm apart by air gaps 87 and formed by deep Si etching from the frontside through the entire wafer 82 to provide a vertical profile and smooth morphology. A source power of 800 W and stage power of 8 W were used at 30 mTorr with 130 sccm $SF_6$ and 13 sccm $O_2$ in the 11-s etch cycles. The self-induced dc bias at the stage was 85 V. A 600 W source power was applied with no stage power at 13 mTorr and 85 sccm $C_4F_8$ in the 8-s passivation cycles. As shown in FIG. 3, Poly-Si interconnections on the dielectric membranes span the 500 μm air gap 34. This 500 μm wide air gap 34 around the heating elements 32 dramatically improves the thermal isolation.

Figure 8F:
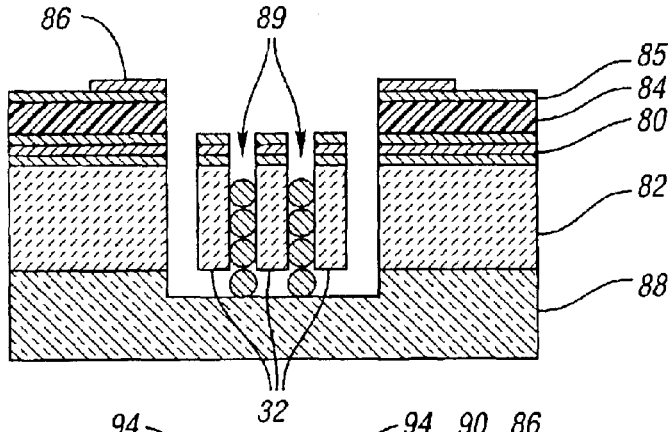

As shown in FIG. 8*f*, an adsorbent material 89, Carbopack X (40/60 mesh, Supelco, Eighty-Four, Pa.), is a graphitized carbon having a specific surface area of 250 $m^2/g$ and is packed in the air gaps. This material 89 is suitable for capturing (and releasing) compounds with vapor pressures in the range of 5 to 95 Torr, and would comprise the second stage of the ultimate multi-stage PCF. A sample of the Carbopack X was passed through a sieve to isolate granules with diameters in the range of 180 to 220 μm. A 1.8 mg sample of the size-segregated adsorbent 89 was manually transferred to the microheater structure and carefully packed between the heating elements 32 as shown in FIG. 8*f*.

Figure 8G:
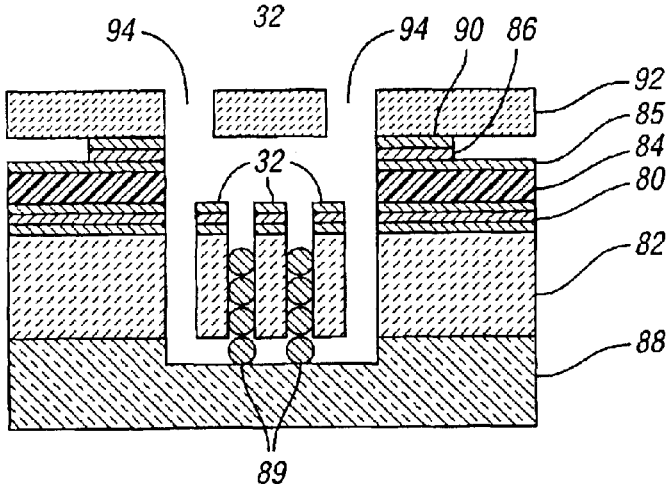
Figure 8H:
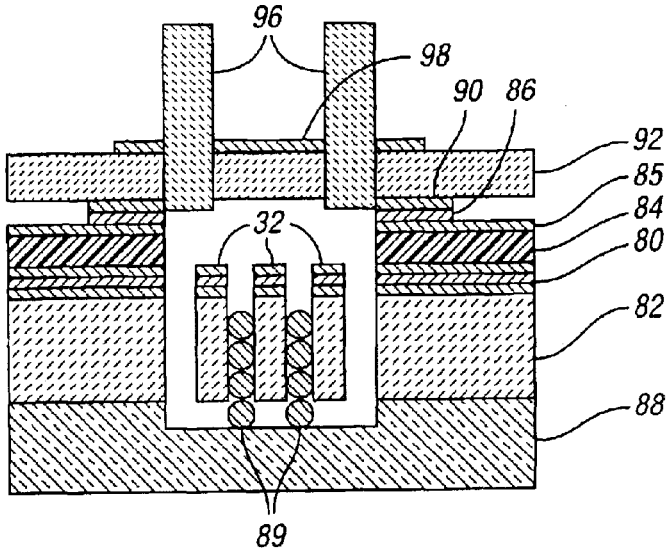

FIGS. 8*g* and 8*h* summarize the process used to seal the top of the PCF. Cr/Al was deposited on a pyrex glass cover plate 92 and patterned to form a bonding ring 90. Two 500 μm diameter inlet and outlet ports 94 2.8 mm apart were then drilled through the pyrex glass plate 92. The bonding ring 90 was then aligned to the poly-Si bonding areas (96 in FIG. 3) and placed in contact with the microheater, and a glass/metal/Si solder bonding was formed by rapid thermal annealing at 800° C. for 2 minutes. Two sections of passivated fused silica capillary or tubing 96 (320 μm i.d., 430 μm o.d., 6 cm long) were wrapped with a thin layer of Teflon tape, inserted into the inlet and outlet holes 94 and sealed with a polyimide adhesive 98 that was then cured at 200° C. for 5 minutes.

Figure 1:
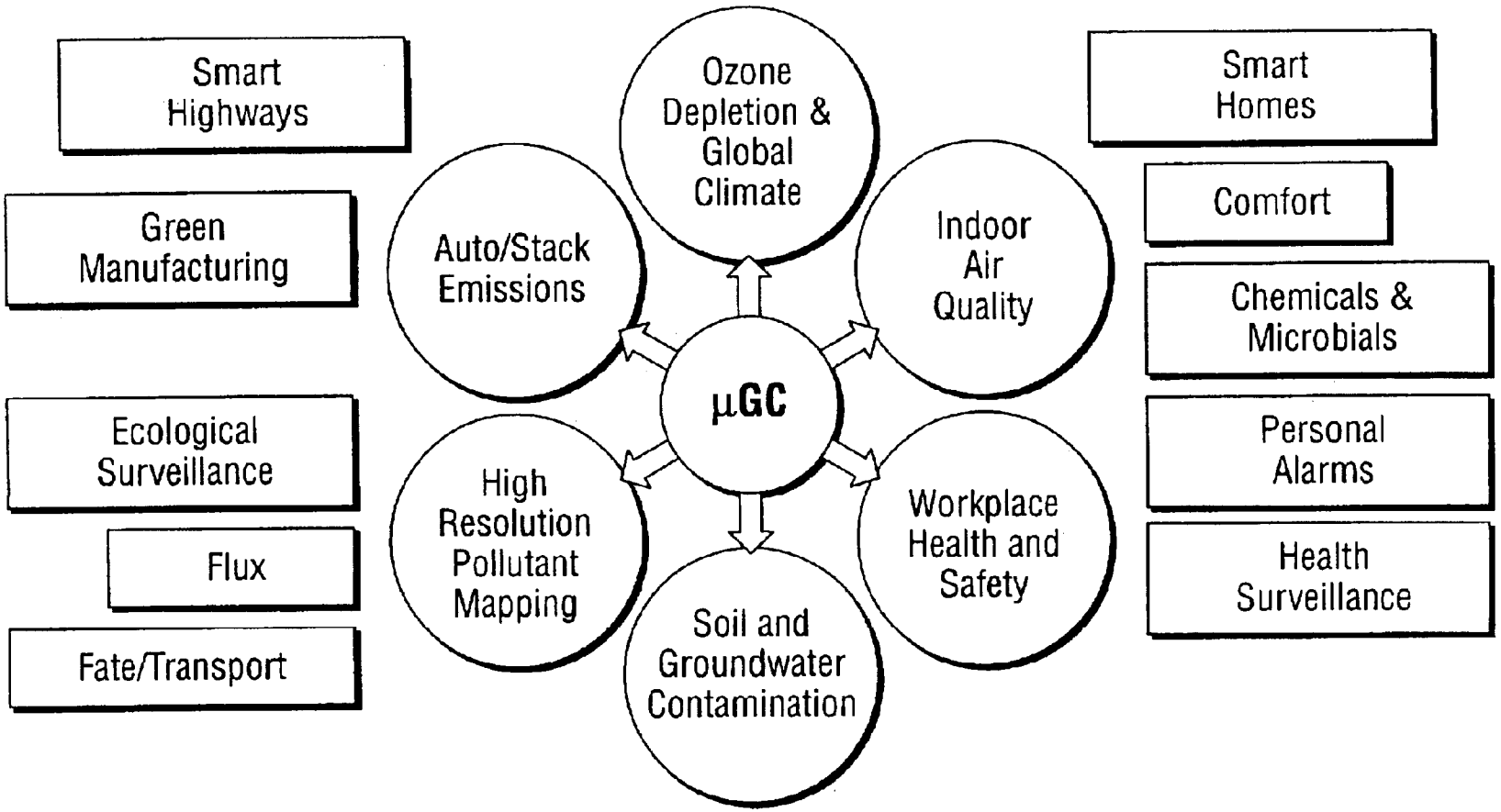
FIG. 1 is a schematic environmental view of a micro analytical system, such as a micro gas chromatograph (i.e., $\mu$GC), used for trace analysis of complex mixtures of gas-phase compounds.
Figure 2:
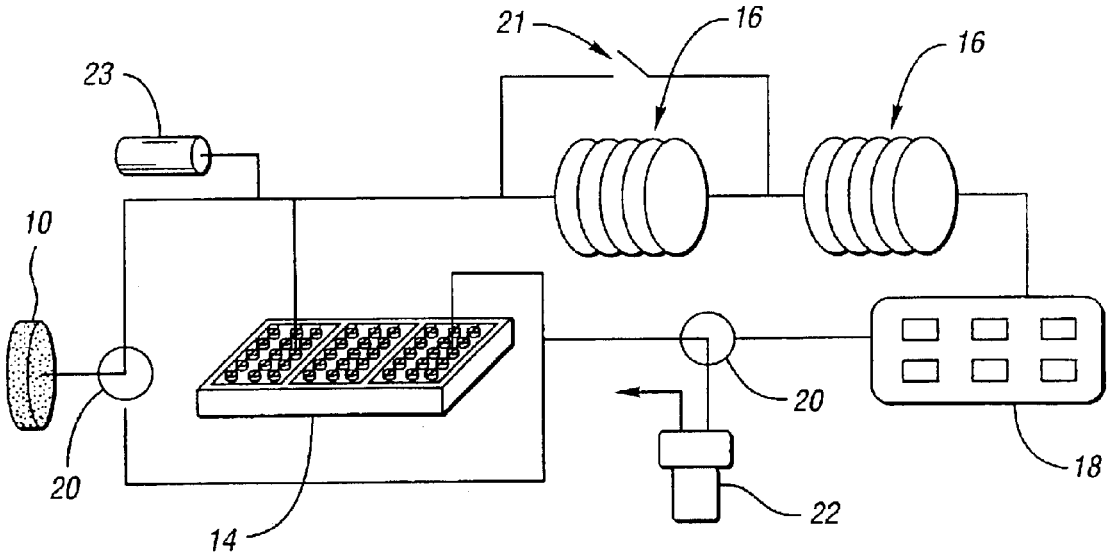
FIG. 2 is a schematic view of the $\mu$GC of FIG. 1.
Figure 5:
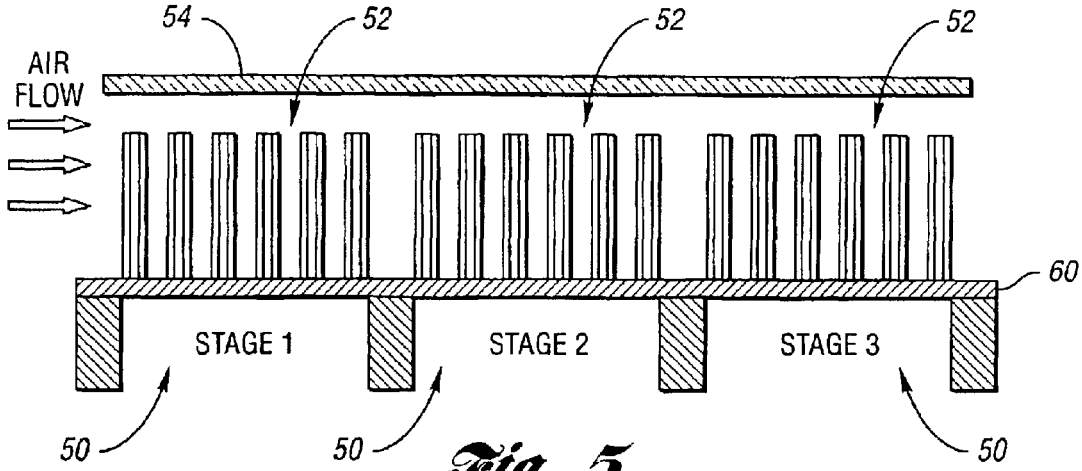
FIG. 5 is a side schematic view of a multi-stage fluid preconcentrator device of a first embodiment of the present invention.
Figure 6:
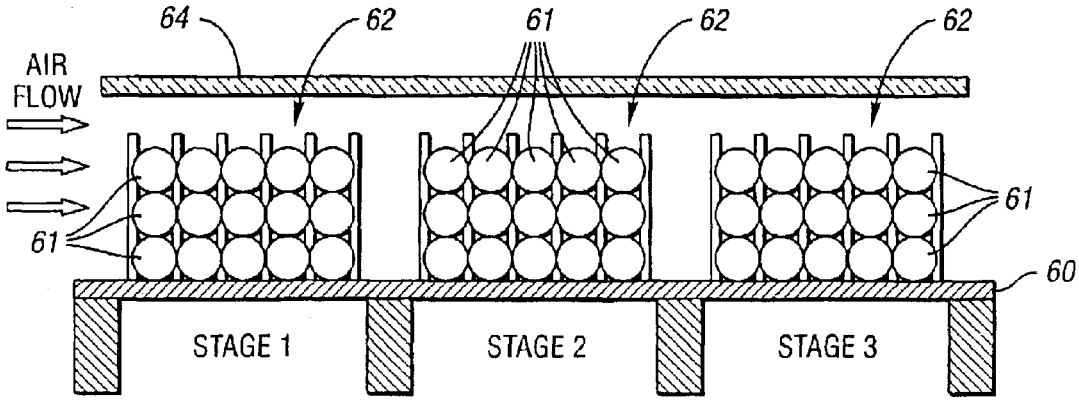
FIG. 6 is a side schematic view of a multi-stage fluid preconcentrator device of a second embodiment of the present invention.

The three-stage PCF devices of FIGS. 5 and 6 for the μGC shown in FIGS. 1 and 2 address the need for high capacity and high efficiency. FIG. 5 shows a metal or back-etched Si membrane 50 on which doped-Si or metal heater cores or elements 52 having adsorbent layers are supported. A glass cover plate 54 seals the device.

In like fashion, FIG. 6 shows a metal or back-etched Si membrane 60 on which different adsorbent beads 61 located between metal/doped-Si heating elements 62 are supported. Typically, each stage of the devices of FIGS. 5 and 6 has different adsorbent properties.

Summary

Tall microheaters (~550 μm) in Si with high aspect ratio heating elements (up to 80:1) and porous carbon granules as adsorbents have been designed and fabricated as μPCF. In addition, conformal coatings can also be used as the adsorbents. Microheaters including tall heating elements can be fabricated in Si, metal, or any conductive materials. The heating elements can be post, slat, grid, or serpentine structures. They can be either freestanding elements or sit on membranes. Heating is accomplished by either flowing electrical current through the heating elements or heating the bottom membrane and conducting heat to the heating elements above the membrane. These tall and high aspect ratio microheaters provide large adsorbent capacity, efficient heating for the PCF and therefore high performance.

The length of the devices can be varied to ensure adequate residence time for efficient fluid adsorption at different flow rates and to allow adsorbents of different structure, porosity, and specific surface area to be used in series within the PCF. Each stage with different adsorbents could be heated separately. These multiple stage PCFs of FIGS. 5 and 6 allow a wide range of fluid to be trapped.

The adsorbent materials can be commercial porous carbon granules, porous films, conformal coatings or porous Si. Porous films can be fabricated by using electroplating, electron beam evaporation, sputtering deposition, electrochemical etching, or any other semiconductor compatible technology. The adsorbent porosity can be varied by the fabrication conditions. Conformal coatings can be produced by chemical vapor deposition or plasma deposition and the adsorbent porosity can be adjusted by the deposition conditions. In addition, the heater and coating can be originated from a single structure. For example, plasma treatment can be applied to change the porosity of the heating element so that the heater surface becomes adsorptive. For the case of Si, porous Si can be formed along the surface of the heating elements to act as adsorbents.

Cone-shaped holes are microfabricated in the cover plate of the micro analytical system as inlet and outlet as shown in FIG. 8*g*. Fused silica tubing or other materials (softer than Si) with low thermal conductivity can be inserted into the cone-shaped holes and the tapered sidewalls of the inlet and outlet will provide a tight seal between the tubing and the cover plate as shown in FIG. 8*h*. These tubes can also serve as anchors to freestand the micro analytical system and conduction heat loss to external structures can be minimized.

The benefits accruing the invention include, but are not limited to, the following:

1. The preconcentrator/focuser (PCF) provides quantitative trapping of a wide range of organic vapors for environmental monitoring, workplace monitoring, or medical diagnostics (e.g., breath analysis).
2. The PCF provides a high preconcentration factor (>5600 demonstrated) which improves detection limits (increasing sensitivity) for target analytes.
3. The PCF provides a sharp desorbed-vapor pulse, which facilitates high resolution chromatographic separation downstream and/or sensitive detection downstream (signal-to-noise ratio $>4.5\times10^4$ demonstrated).
4. Tall (>550 μm demonstrated) and high aspect ratio (>80:1 demonstrated) microheaters provide large surface area for large adsorbent capacity in a PCF.
5. Tall and high aspect ratio microheaters for the PCF reduce the thermal mass for lower power consumption.
6. The small PCF volume makes it easier to integrate PCF in a μGC.
7. Higher thermal transfer efficiency is obtained by having an intimate contact between large surface area heating elements and adsorbents.
8. The dead volume inside the PCF is minimized (<a few μL demonstrated).
9. The cone-shaped holes on cover plate provides a tight seal between the tubing and the cover plate.
10. Conduction heat loss is reduced by freestanding the PCF using fused silica tubing or other tubing (softer than Si) made of low thermal conductivity materials.
11. Conduction heat loss is reduced by placing the PCF on a thin membrane or by etching trenches in the supporting substrate.
12. The heat loss due to forced convection inside the PCF is reduced by using conformal adsorbent on the sidewalls of the heating elements.

Figure 9:
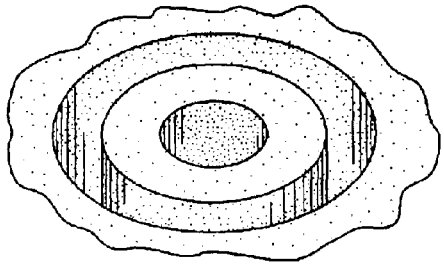
FIG. 9 is a schematic perspective view of a double ring adapter which can be used and inlet/outlets on a cover plate to provide a tight seal between fused silica tubing and the cover plate.

The following are features of the invention(s) and include, but are not limited to:

1. The microheater functions as a micro chemical reactor for micro analysis of fluids in gas phase or liquid phase.
2. The tall preconcentrator/focuser (PCF) provides large adsorbent capacity to trap fluid in the environment, exhaled breath, or other fluidic media.
3. Tall microheaters (>550 μm demonstrated) provide large surface area for large adsorbent capacity in a PCF.
4. Tall and high aspect ratio (>80:1 demonstrated) microheaters in the PCF reduce the thermal mass.
5. The small PCF volume makes it easier to integrate PCF in a μGC.
6. Microheaters consisting of tall heating elements can be fabricated in Si, metal, or any conductive materials.
7. The heating elements can be post, slat, grid, or serpentine structures.
8. The heating elements can be either freestanding or sit on a membrane.
9. The heating can be accomplished by flowing electrical current through heating elements or heating the bottom membrane and conducting heat to the heating elements above the membrane.
10. Higher thermal transfer efficiency can be obtained by having an intimate contact between large surface area heating elements and adsorbents.
11. Multiple stage PCF with different adsorbents is used to expand the range of fluids that can be trapped.
12. Air gaps inside the PCF are used to reduce the pressure drop and increase the fluid flow uniformity.
13. Cross-wise slats and air gap arrangement inside the PCF prevent mixing of different adsorbent granules in a multiple-adsorbent PCF.
14. Microfabricated cone-shaped holes or a double ring adapter as shown in FIG. 9 as inlet and outlet on cover plate provide a tight seal between fused silica tubing and cover plate.
15. Thermally isolated microheaters can be fabricated by placing air gaps around the heating elements and reducing the contacts of heating elements with the surrounding structures.
16. Conduction heat loss can be reduced by freestanding the entire PCF using fused silica tubing, tubing (softer than Si) with low thermal conductivity materials, or Si itself.
17. Conduction heat loss can be reduced by placing the entire PCF on thin membrane or by etching trenches in supporting substrate.
18. Convection heat loss of the PCF can be reduced by using a vacuum environment around the PCF.
19. Heat loss due to forced convection inside the PCF can be reduced by coating adsorbents conformally on the sidewalls of the heating elements.
20. The adsorbents can be commercial porous carbon granules, metal films, Si, or any other material with porous and sorptive properties.
21. The adsorbents around the microheater can be a conformal coating using CVD or plasma deposition.
22. Adsorbent layer can be the surface of the heating elements.
23. Plasma treatments can be applied to the surface of the heating elements to change their porosity.

The microelectromechanical heating apparatus of the present invention have use in 3D Micro Analytical, 3D Micro Sensing and Programmable Temperature-Controlled Micro Analytical Systems as follows:

3D Micro Analytical System

The tall microheater of the present invention has a high ratio of height-to-width, and it can serve as a micro chemical reactor and provide a small ratio of sample volume-to-surface area. Unlike other thin microheaters, the present microheater consists of arrays of several large surface area heating elements and provides very uniform 3D heating. Thus, temperature can be controlled precisely through the entire chamber volume. The major advantages of this 3D micro analytical system will be a 3D temperature-controlled function. For example, the byproduct of protein synthesis can be minimized because the protein will be maintained at the set value through the whole sample volume. So, chemical reaction, mixing, or heat exchange can be done precisely and efficiently.

3D Micro Sensing System

The tall microheater of the present invention, with high ratio of height-to-width, can also serve in a 3D chemical, temperature, or pressure sensing system. For the 3D chemical sensing system, the sensing material can be applied to the large surface area of the structures so the sensitivity or response time can be improved. For temperature or pressure sensing, again the large surface area of our structures enhance the sensitivity significantly. Also, a 3D distribution can be obtained by placing some built-in resistive sensors around the surface of the sensing system.

Programmable Temperature-Controlled Micro Analytical System

Built-in resistive temperature sensors can be placed on the surface of the micro analytical system to provide closed-loop temperature control. The temperature of the micro analytical system can be adjusted by a feedback signal from a built-in temperature sensor so the power applied to the micro analytical system can be adjusted to a set value precisely.

Also, the micro analytical system can be connected individually or built within the same substrate to form a multi-stage temperature-controlled micro analytical system. Therefore, different temperature and heating rate for different stages can be controlled independently.

Normally, the width of the heating elements in the microheater is from few to tens of micrometer. If the width of the heating elements are reduced to the nanometer range, a nanoheater providing a larger surface area per unit volume compared to microheater can be obtained. Therefore, with the same surface area, the size of the nanoheater is smaller than the microheater. The major advantages of these nanoheaters are small thermal mass and low power consumption.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. A microelectromechanical heating apparatus comprising:

a first substrate; and a heater including an array of heating elements supported in spaced relationship on the substrate wherein the heating elements are sized and spaced to substantially uniformly heat a heating chamber within the heater.

2. The apparatus as claimed in claim 1, wherein the heating elements are located in the heating chamber.

3. The apparatus as claimed in claim 1, wherein a ratio of height to width of each of the heating elements is greater than one.

4. The apparatus as claimed in claim 1, wherein the first substrate is a semiconductor substrate.

5. The apparatus as claimed in claim 4, wherein the semiconductor substrate is a silicon substrate.

6. The apparatus as claimed in claim 1, further comprising a support for supporting each of the heating elements at a single support location.

7. The apparatus as claimed in claim 6, wherein the support supports each of the heating elements at an end of the heating elements.

8. The apparatus as claimed in claim 6, wherein the support is a membrane.

9. The apparatus as claimed in claim 6, wherein each of the heating elements conducts heat from the support.

10. The apparatus as claimed in claim 1, further comprising a support for supporting each of the heating elements at a pair of spaced support locations.

11. The apparatus as claimed in claim 10, wherein the support supports each of the heating elements at ends of the heating elements.

12. The apparatus as claimed in claim 8, wherein each of the heating elements converts electrical energy into heat.

13. The apparatus as claimed in claim 12, further comprising interconnects formed on the heater and electrically coupled to the heating elements to receive an electrical signal which in turn causes electrical current to flow through the heating elements to control and directly heat the heating elements.

14. The apparatus as claimed in claim 1, further comprising a second substrate connected to the first substrate wherein the heating elements are separated from the first and second substrates by air gaps to thermally isolate the heating elements.

15. The apparatus as claimed in claim 10, wherein the support is formed on the substrate and thermally isolated from the substrate.

16. The apparatus as claimed in claim 1, further comprising at least one sensor to sense a physical or chemical stimulus and provide a corresponding signal for control purposes.

17. The apparatus as claimed in claim 16, wherein the at least one sensor includes at least one temperature sensor for controlling temperature within the heating chamber.

18. The apparatus as claimed in claim 1, wherein the heating elements are fabricated in Si, metal, or any conductive material.

19. The apparatus as claimed in claim 1, wherein the heating elements are post, slat, grid or serpentine structures having relatively large surface areas.

20. The apparatus as claimed in claim 1, wherein the heating elements are formed in multiple stages with various heater dimensions and adsorbents in each stage.

21. A microelectromechanical heating apparatus for a microanalytical system, the apparatus comprising:

a first substrate; and a heater including at least one array of heating elements supported in spaced relationship on the substrate wherein the heating elements are sized and spaced to substantially uniformly heat a heating chamber within the heater.

22. The apparatus as claimed in claim 21, further comprising at least one sensor to sense a physical or chemical stimulus and provide a corresponding control signal.

23. The apparatus as claimed in claim 22, wherein the at least one sensor includes at least one temperature sensor for controlling temperature within the heating chamber.

24. The apparatus as claimed in claim 21, wherein the heater includes a plurality of arrays of large surface area heating elements to provide substantially uniform 3D heating.

25. A microelectromechanical heating apparatus for a microsensing system, the apparatus comprising:

a first substrate; and a heater including an array of heating elements supported in spaced relationship on the substrate wherein the heating elements are sized and spaced to substantially uniformly heat a heating chamber within the heater.

26. The apparatus as claimed in claim 21, wherein the system is a chemical microsensing system and wherein the apparatus further comprises chemical sensing material disposed in the heating chamber.

27. The apparatus as claimed in claim 21, further comprising at least one sensor to sense a physical or chemical stimulus and provide a corresponding control signal.

28. The apparatus as claimed in claim 25, wherein the microsensing system serves as a 3D micro chemical sensing system, wherein the apparatus further comprises sensing material applied to large surface area of the heating elements for improved sensitivity and response time and sensing electrodes distributed along a surface of the heating apparatus for 3D detection of chemical distribution.

29. The apparatus as claimed in claim 25, wherein the microsensing system serves as a 3D micro temperature sensing system, wherein the apparatus further comprises resistive temperature sensors, distributed along a surface of the heating apparatus for 3D monitoring of temperature distribution.

30. The apparatus as claimed in claim 25, wherein the microsensing system serves as a 3D micro pressure sensing system, wherein the apparatus further comprises a resistive pressure sensor, such as poly-Si, distributed around a surface of the heating apparatus for 3D monitoring of pressure distribution.

* * * * *